US005296018A

United States Patent [19]

Suzuki

[11] Patent Number: 5,296,018

[45] Date of Patent: Mar. 22, 1994

[54] METHOD AND APPARATUS FOR ELIMINATING ELECTRIC CHARGES IN A CLEAN ROOM

[75] Inventor: Masanori Suzuki, Tokyo, Japan

[73] Assignee: Techno Ryowa Co., Ltd., Tokyo, Japan

[21] Appl. No.: 946,820

[22] Filed: Sep. 18, 1992

Related U.S. Application Data

[63] Continuation of Ser. No. 670,785, Mar. 19, 1991, abandoned.

[30] Foreign Application Priority Data

Nov. 28, 1990 [JP] Japan ..... 2-322523

[51] Int. Cl.[5] ..... B03C 3/01

[52] U.S. Cl. ..... 95/65; 55/385.2; 95/69; 95/70; 96/52; 96/57; 96/74

[58] Field of Search ..... 55/8, 122, 126, 136, 55/138, 385.2, 152; 95/65, 69, 70; 96/52, 57, 74

[56] References Cited

U.S. PATENT DOCUMENTS

| | | | |
|---|---|---|---|
| 2,024,226 | 12/1935 | Irwin et al. | 55/122 |
| 2,634,818 | 4/1953 | Wintermute | 55/136 X |
| 2,862,354 | 12/1958 | Barnhart | 55/122 |
| 3,826,063 | 7/1974 | Festner | 55/136 X |
| 4,266,948 | 5/1981 | Teague et al. | 55/152 X |
| 4,534,776 | 8/1985 | Mammel et al. | 55/136 |
| 4,781,732 | 11/1988 | Wondrasch et al. | 55/122 X |
| 4,909,161 | 3/1990 | Germain | 55/122 X |
| 4,955,991 | 9/1990 | Torok et al. | 55/152 X |

*Primary Examiner*—Richard L. Chiesa

*Attorney, Agent, or Firm*—Wegner, Cantor, Mueller & Player

[57] ABSTRACT

A method and apparatus for eliminating electric charges in a clean room is disclosed involving removing fine and superfine grains from air in the clean room, and generating ions in the thus purified air inside the room.

3 Claims, 4 Drawing Sheets

PRIOR ART

METHOD AND APPARATUS FOR ELIMINATING ELECTRIC CHARGES IN A CLEAN ROOM

This application is a continuation of U.S. application Ser. No. 07/670,785 filed Mar. 19, 1991, now abandoned.

BACKGROUND OF THE INVENTION

1. Field of the Invention

The present invention relates to methods and apparatus for eliminating static electricity in a clean room, using an ion generator. More particularly, the present invention relates to techniques of preventing the generation of fine grains which would deposit collectively on the surfaces of electrodes of an ion generator, and resplash to contaminate the clean room.

2. Related Art

Generally, factories which manufacture semiconductors are in low humidity environments with a relative humidity of about 40%. Plastic containers which are used to carry semiconductor elements and wafers enclosed therein have high electrical resistance and are likely to be electrically charged. Therefore, static electricity will be generated in the clean room. This static electricity causes dust to be deposited on the surface of wafers and hence the resulting products would be defective. Especially, the density of the semiconductor devices has recently being increased. Thus, if only a little dust deposits on the surface of a wafer, it would cause a pattern of the semiconductor device to be defective to thereby adversely affect the characteristic of the semiconductor device. Thus, semiconductor devices must be manufactured in a clean room with a degree of cleanliness close to a dust-free state.

The electromagnetic waves generated when static electricity can destroy ICs on wafers and semiconductor devices, thereby reducing product yield. Especially, as the degree of integration of semiconductor devices increases, their electrostatic resistance is decreased. Such a hindrance to manufacture due to static electricity is a big problem.

For the above reason, an ion generator is used to eliminate static electricity in the clean room. It applies high voltage across its electrodes to cause a discharge to thereby generate ions which are used to neutralize and eliminate the electric charges on the object.

One example of such ion generators is shown in FIG. 4. A clean room 1 has on its ceiling a high performance filter 5 through which clean air is fed into the room, and an ion generator 2 which eliminates static electricity. Ion generator 2 applies positive and negative high voltages to positive and negative needle electrodes 3, respectively, to generate a corona discharge. This changes the air around the needle electrodes 3 to positive and negative ions 4 which are carried by a flow of air from filter 5 to thereby neutralize opposite-polarity electric charges, respectively, on an object 6 with ions 4.

According to such ion generator 2, semiconductors which have high electrical resistance and which are difficult to leak electric charges by grounding can be neutralized electrically.

It is known that fine grains would be splashed from the electrodes 3 of the ion generator. These grains would contaminate the air in the clean room and hence be a hindrance to the manufacture of semiconductors.

The following causes of the splashing of the fine grains are known:

(a) Fine grains of the electrodes 3 produced by its wear are splashed; and (b) The $SiO_2$ fine grains in the air which are not eliminated by filter 5 deposit on the electrodes 3. If these grains are gathered to become particular larger ones, they would be resplashed.

Concerning the wear of the electrodes 3, electrodes the wear rate of which is decreased have been provided by improving the electrode materials.

However, no measures have been established against the resplashing of $SiO_2$ fine grains. Even if fine grains with a size of 0.03 μm or more (measurable at present) are removed by the filter 5 from the air which is fed into the clean room 1, fine grains with a size of 0.03 –0.1 μm are splashed from the needle electrodes 3 in ion generator 2. It is clarified by analysis that these fine grains are of $SiO_2$. In an uneven field such as that present around the ion generator electrodes, neutral (polarized) grains are drawn by a gradient force toward a higher field strength and deposit on the electrodes now under corona discharge. Therefore, the fine grains with a size of 0.005 μm (hereinafter referred to as superfine grains) which have passed through the filter 5 are captured and collected by the needle electrodes 3 into fine grains with a size of 0.03–0.1 μm, which would be resplashed in the clean room. The splashed grains would contaminate the surface of the wafers, etc. Therefore, it is very difficult to use the ion generator in a high purification degree clean room which is required to eliminate fine grains on the order of 0.1 μm.

It is an object of the present invention to provide a method and apparatus for eliminating electrical charges in the clean room where no $SiO_2$ fine grains deposit on the ion generating electrodes and hence no dust due to resplashing of such $SiO_2$ grains is produced when clean air which contains no $SiO_2$ fine grains is fed to the vicinity of the ion generating electrodes and static electricity in the clean room is eliminated.

It is another object of the present invention to purify the air fed to the vicinity of the ion generating electrodes by causing superfine grains which cannot be captured by the filter to deposit on the discharging electrodes so as to be larger grains which are captured with the filter, and then capturing the larger grains with the filter.

It is a further object of the present invention to purify the air fed to the vicinity of ion generating electrodes by causing superfine grains which cannot be captured with the filter to pass through pure water to thereby cause the grains to be captured with the pure water.

It is a still further object of the present invention to provide a method and an apparatus for removing electric charges in the clean room which is capable of maintaining a high degree of cleanliness, causing the ions generated by an ion generator in the clean room to neutralize the electric charges to thereby eliminate a possible obstacle to the manufacture due to static electricity and hence to ensure the manufacture of a high density semiconductor device.

SUMMARY OF THE INVENTION

The invention of is a method of removing electric charges in a clean room, comprising the steps of: applying high voltage to an ion generating electrode provided in the clean room to generate ions at the electrode and feeding the ions into the clean room; feeding air to the vicinity of the ion generating electrode; and purifying the air before the air is fed to the ion generating electrode.

The invention also includes the steps of feeding the air, to be purified, through a purifying discharge electrode, depositing superfine grains in the air on the purifying discharge electrode, and capturing with a filter larger grains splashed from the purifying discharge electrode.

The invention also includes the step of passing the air, to be purified, through pure water to eliminate superfine grains in the air with the pure water.

The invention also includes an apparatus for removing electric charges in a clean room, comprising: ion generating electrode means provided in the clean room; ion generating means for applying a voltage to the ion generating electrode means to feed ions from the ion generating electrode means into the clean room; air discharge port means for discharging therethrough the air in the clean room out of the clean room; air feed port means for feeding therethrough the air to the vicinity of the ion generating electrode means; draft pipe means extending between the air discharge and feed port means; purifying discharge electrode means provided in the draft pipe means; and filter means provided between the discharge electrode means and the air feed port means.

The invention also includes reservoir tank means for pure water provided in the draft pipe means; and means for causing purifying air to bubble into the tank means.

In the invention according to one embodiment, the superfine grain-free air is fed to the vicinity of the ion generating electrode of the ion generator. As a result, no fine grains are deposited on and splashed from the ion generating electrode and hence the clean room is not contaminated with fine grains which would otherwise be splashed from the electrodes.

In the invention according to another embodiment, the air in the clean room which contains superfine grains which cannot be captured with the filter is fed from the air discharge port toward the purifying discharge electrode provided in the draft pipe. The superfine grains in air deposit and collect on the purifying discharge electrode to thereby form larger grains. The larger grains are splashed from the purifying discharge electrode by the flow of air through the draft pipe. The air which contain the larger grains is fed to the filter through the draft pipe. The grains in the air have such a size that they are captured with the filter. Thus, they are captured with the filter and the resulting purified air is fed from the filter.

In the invention according to and the embodiment, the air which contains superfine grains discharged to the draft pipe is introduced into the pure water tank provided in the draft pipe, and purified with the pure water to remove the fine and superfine grains.

Figure 1:
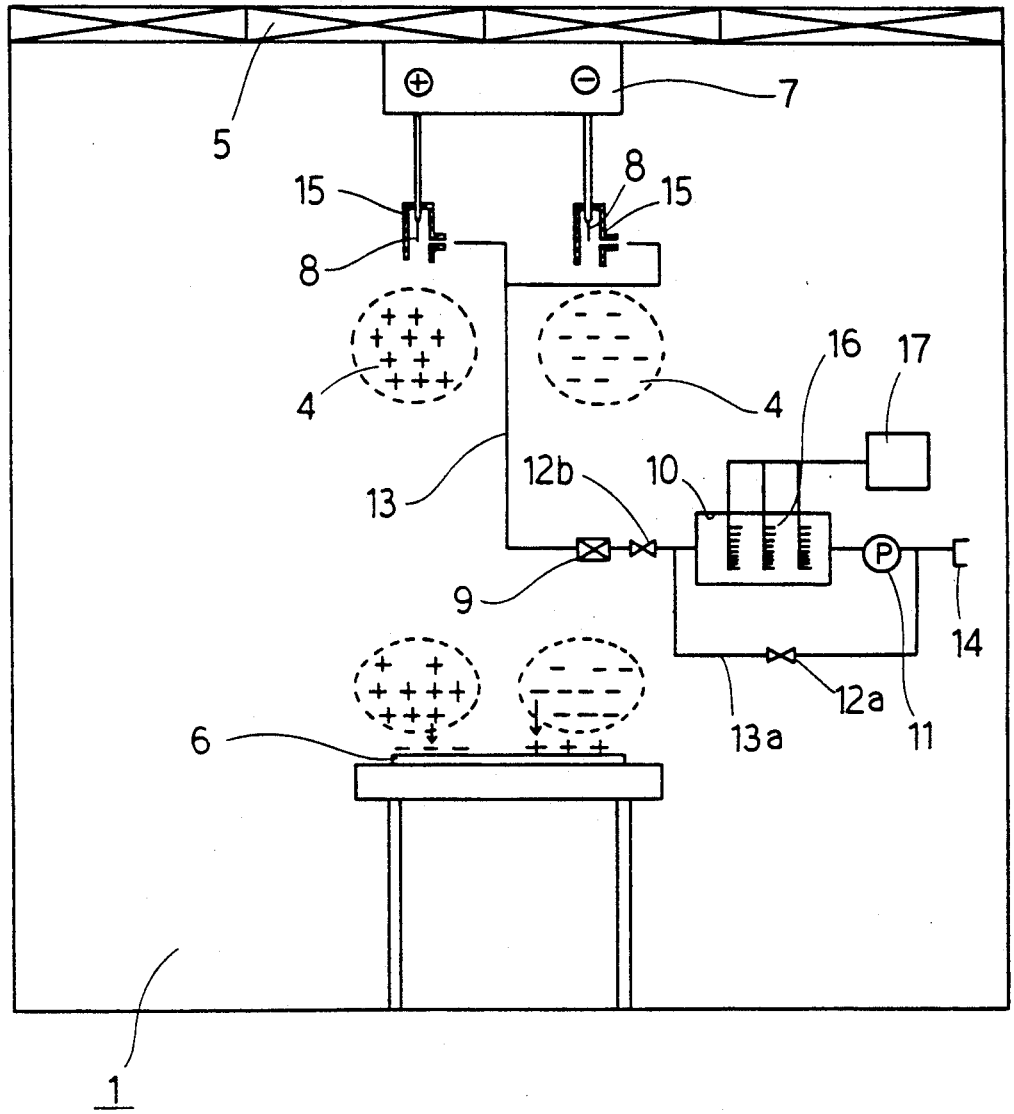
FIG. 1 is a side view of a first embodiment of the present invention.

DETAILED DESCRIPTION OF THE PREFERRED EMBODIMENTS (1) First Embodiment: FIG. 1

Provided on the ceiling of clean room 1 is a filter 5 which can capture fine grains having a size of 0.03 μm or more. External air is fed through filter 5 into room 1. Since filter 5 is provided covering the entire region of the ceiling, a flow of air from the ceiling toward the floor is formed in the clean room.

An ion generator 7 is also provided on the ceiling of room 1. It is called a pulsed-DC system and a pair of positive and negative special tungsten needle electrodes 8 is provided at an interval of 29 cm. The pair of electrodes 8 are impressed with ±13–±20 kV DC voltages at intervals of 1–11 seconds to thereby generate positive and negative ions alternately from the positive and negative needle electrodes 8, respectively.

A draft pipe 13 is provided in clean room 1 to purify the internal air in the clean room and to feed it to the vicinity of the needle electrodes 8. Room 1 has an air discharge port 14 through which the air in the room is fed to draft pipe 13. Feed ports 15 for the purified air are provided in the vicinity of corresponding needle electrodes 8. Draft pipe 13 connects air discharge port 14 and air feed ports 15. Draft pipe 13 has an air pump 11 the blowing force of which draws the air in room 1 through air discharge port 14 and discharges it from feed ports 15.

An ion generator 10 is provided in the draft pipe 13 in order to capture the superfine grains and to resplash them in the form of larger grains. Ion generator 10 includes a plurality of positive or negative needle electrodes 16 like ion generator 7 in the clean room. When an AC or Dc current is supplied from a power source 17 to ion generator 10, needle electrodes 16 generate positive or negative ions. When needle electrodes 16 perform a corona discharge, superfine grains having a size of about 0.005 μm or less are deposited and collected on needle electrodes 16 by the resulting electrical drawing force. When the deposited superfine grains grow to grains having a size of about 0.03 μm, they are resplashed from needle electrodes 16.

Draft pipe 13 has a membrane filter 9. Filter 9 captures fine grains having a size of about 0.03 μm or more resplashed from needle electrodes 16.

Draft pipe 13 has a bypass path **13*a* through which the air from ion generator 10 is returned to before generator 10. Bypass path 13*a* has a valve 12*a*. An air feed pipe 13 leading to membrane filter 9 has a valve 12*b***.

In operation, when air pump 11 operates, the air in room 1 is fed into ion generator 10 from air discharge port 14 through draft pipe 13. Needle electrodes 16 of ion generator 10 perform a corona discharge such that superfine grains having a size of 0.005 μm or less which cannot be captured with the filter on the room ceiling are captured and collected so as to form larger grains having a size of 0.03 μm. The larger grains are resplashed from needle electrodes 16 by the blowing force generated by air pump 11.

When the air which has passed through ion generator 10 is fed to membrane filter 9 by opening valve **12*b* of the draft pipe 13, filter 9 captures fine grains having a size of about 0.03 μm contained in the air. Finally, the air from which the fine grains are captured and removed is fed from air feed ports 15 to the vicinity of ion generating electrodes 8 of ion generator 7. Since this air contains no superfine grains having a size of 0.005 μm or less, no fine grains are collected on needle electrodes 8 and resplashed even if ion generator 7** operates.

The air fed from feed ports 15 is carried downward in room 1 by the flow of air from filter 5 provided on the room ceiling. At this time, superfine grains having a size of 0.005 μm or less which cannot be captured by the filter are contained in the air from filter 5, but the air flows downward from the ceiling, so that the air in which the superfine grains are mixed in a lower portion of room 1 does not come near needle electrodes 8. Thus, no super-high grains are collected on the needle electrodes 8 and deposited as larger grains.

When valve **12*b* is closed and valve 12*a* is opened, the air having passed through ion generator 10 is again fed to ion generator 10 through bypass path 13*a*. After air is recirculated a few times through ion generator 10, valve 12*a* is closed and valve 12*b* is opened to feed air into membrane filter 9. In this way, the superfine grains having a size of 0.005 μm or less are captured more effectively by needle electrodes 8** to thereby improve the degree of purification of the air.

As described above, according to the present embodiment, no fine grain dusts are generated from needle electrodes 8 and static electricity is eliminated even if ion generator 7 provided in clean room 1 operates. Therefore, deposition of dust on the surface of a wafer due to static electricity as well as destruction of ICs and semiconductor devices are prevented.

Ion generators other than the generator shown may be used when required in the present embodiment. For example, a grid-like generator called an AC system may be used. The shape and number of filters installed may be changed when required.

Figure 2:
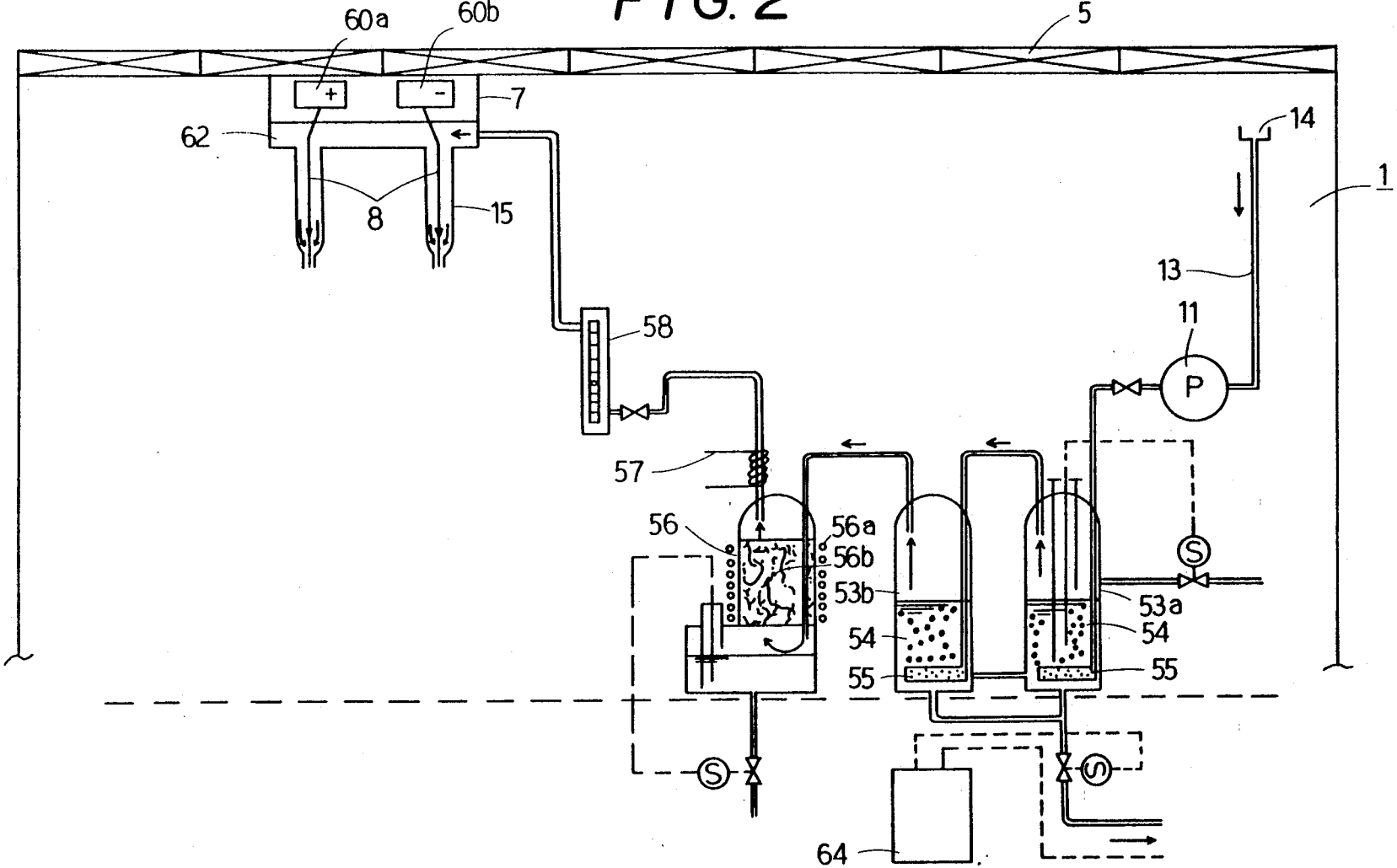
FIG. 2 is a side view of a second embodiment of the present invention.

(2) Second Embodiment: FIG. 2

In the second embodiment, filter 5 and ion generator 7 having needle electrodes 8 are provided on the ceiling of clean room 1 as in the first embodiment. Room 1 has air discharge port 14 which discharges air in the room and air feed ports 15 which feed purified air to the vicinity of corresponding electrodes 8. Draft pipe 13 having air pump 11 is provided between air discharge and feed ports 14 and 15.

Provided in draft tube 13 in a multi-stage manner are reservoir tanks **53*a* and 53*b* into which the air in the room 1 flows. Tanks 53*a* and 53*b* contain impurity-free or pure water above which air layers remain. The determination and circulation of the quantity of pure water contained in tanks 53*a* and 53*b* are controlled by a control board 64** and the impurities in the water are eliminated by a water purification device (not shown).

Draft pipe 13 through which air in clean room 1 is fed is provided so as to extend to the vicinity of the bottom of first tank **53*a* and has at a lower end a ceramic porous material with multiple small holes therein. A draft pipe is provided which extends from the air layer in an upper portion of first tank 53*a* to the vicinity of the bottom of second tank 53*b* and has at a lower end a ceramic porous material 55 as in first tank 53*a***.

A mist separator 56 is provided after second tank **53*b*. It includes a cooling coil 56*a* extending around its periphery and therein a fiber body 56*b* which is cooled by cooling coil 56*a*. A draft pipe is provided extending from the air layer in an upper portion of second tank 53*b* to a lower portion of mist separator 56. A heater 57 is wound around a portion of the draft pipe extending from the upper portion of mist separator 56. The draft pipe extends through a flowmeter 58 to nearby air feed port 15 in the vicinity of ion generator 7 in clean room 1**.

In the present embodiment, ion generator 7 includes a pair of high voltage sources **60*a* and 60*b* each with a needle electrode 8 connected thereto. High voltage sources 60*a*, 60*b* and the portions of needle electrodes 8 connected to the high voltage sources are separated from a supply chamber 62 through which the air fed from draft pipe 13 flows. The lower ends of electrodes 8 are covered by nozzle-like air feed ports 15 formed integrally with supply chamber 62**.

In the present embodiment, the air in clean room 1 is purified by filter 5 on the ceiling, but contains superfine grains having a size of 0.005 μm or less which cannot be captured by filter 5. This air, containing the superfine grains, is fed by air pump 11 from air discharge port 14 via draft pipe 13 to first tank **53*a*. The air is discharged from the respective small holes in ceramic porous material 55 provided at the bottom of tank 53*a* into pure water 54. The air becomes small bubbles, which then rise through pure water 54 up to the air layer above pure water 54. At this time, in order to make constant the internal pressure in first tank 53*a*, the same amount of air as that fed to first tank 53*a* is discharged into second tank 53*b*. This air becomes small bubbles in pure water 54 in second tank 53*b* and the bubbles rise through pure water 54 up to the air layer above pure water 54 as in first tank 53*a*. In order to further make constant the internal pressure in second tank 53*b*, the same amount of air that fed to second tank 53*a* is discharged into mist separator 56. This air is dehumidified sufficiently by the cooled mist separator 56. The temperature of the air is then returned to room temperature, adjusted in humidity by heater 57 and then fed to ion generator 7 at a constant flow by flow controller 58. In ion generator 7, high voltage is applied across needle electrodes 8 by positive and negative voltage sources 60*a* and 60*b*, respectively, to cause electrical discharge to ionize the air fed from draft pipe 13**.

In the present embodiment, the air in the clean room becomes small bubbles in the pure water in the air purifying device and the bubbles rise upward in the pure water. Therefore, the surface area of the air which contacts the superpure water is increased and the air contacts the pure water sufficiently. Therefore, the $SiO_2$ fine and superfine grains are captured by the pure water and the percentage of the grains remaining in the air is greatly reduced. By supply of such air to the air ionizing device, no $SiO_2$ fine grains will deposit on the electrodes even if high voltage is applied across the electrodes for eliminating static electricity. Thus, the clean room will not be contaminated at all by resplash of the $SiO_2$ fine grains.

Since fine grains other than the $SiO_2$ grains are also captured by the pure water and hydrophilic gases present in the air are dissolved into the pure water, the purification of the air in the clean room is further improved.

The specified shapes of the components, and the specified positions and methods where the components are attached may be changed when required. For example, the number of tanks which contain pure water is not limited to two. More tanks may be provided in order to make the percentage of fine grains and hydrophilic gases remaining in the air to approach zero limitlessly. The dehumidifying material of the mist separator is not limited to the fiber layer. Other dehumidifying materials may be used as long as they produce no dust from themselves.

A membrane filter which has the function of removing fine grains, for example, of 0.1 μm may be provided after heater 57 in the draft pipe through which air is fed from the mist separator to the air ionizing device. If a very small quantity of $SiO_2$ fine grains which remain unremoved by tanks 53*a* and 53*b* deposit as the cores of droplets on fiber layer 56*b* provided on mist separator 56 are condensed for a long time into larger $SiO_2$ fine grains, which then resplash, the main filter is able to eliminate these larger fine grains.

A plurality of ion generators may be connected to a single pure water tank.

Figure 3:
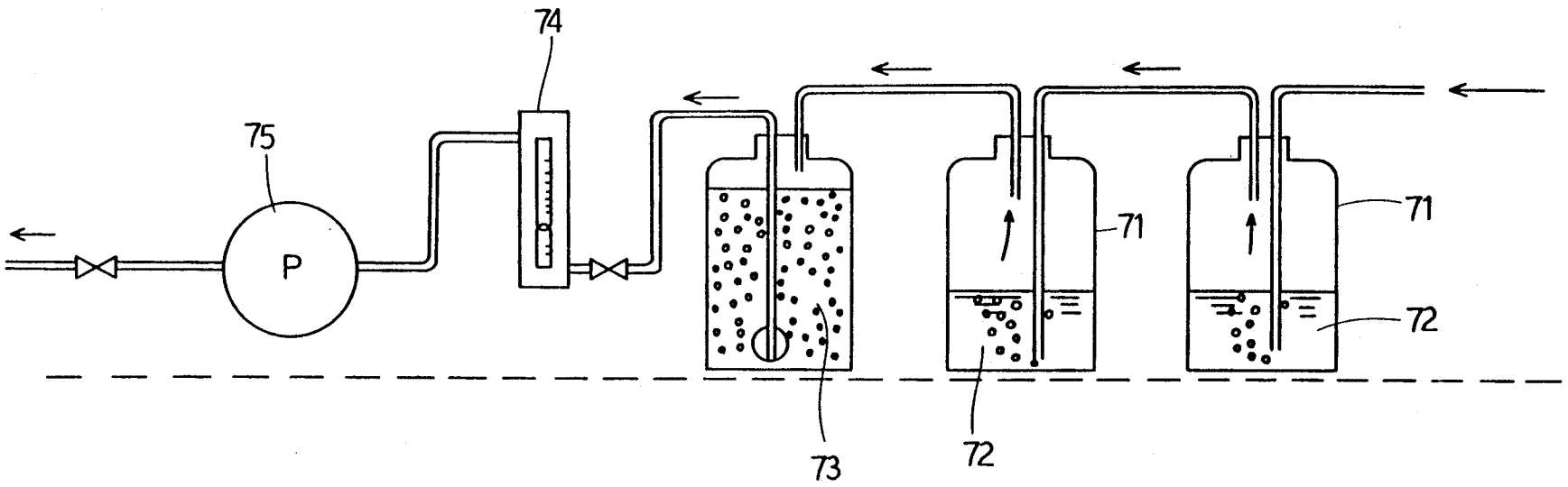
FIG. 3 is a side view of an experimental device which explains the function of the second embodiment.
Figure 4:
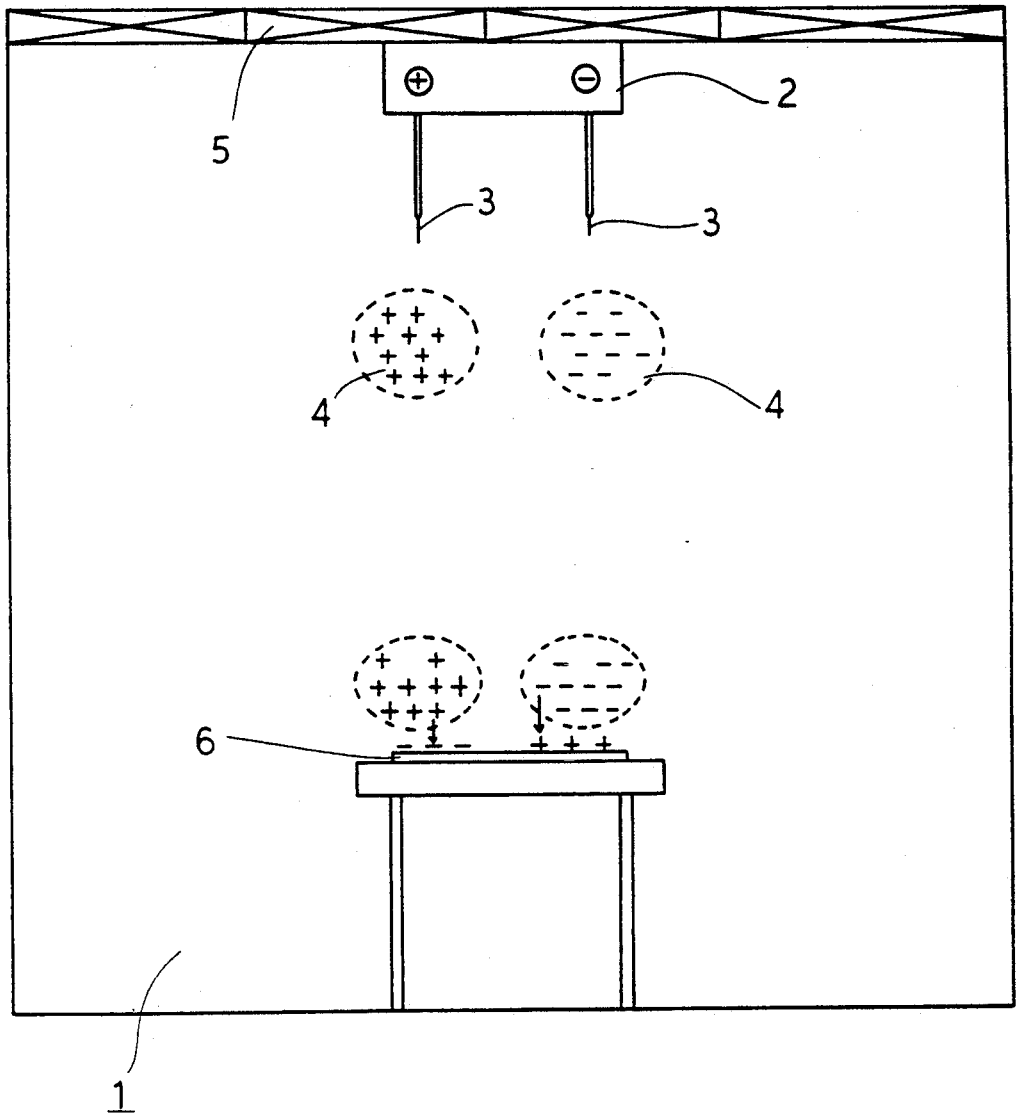
FIG. 4 shows one example of the conventional ion generators.

(3) Experimental Example: FIG. 3

The inventors performed the following experiment in order to measure the effects of the second embodiment. A device shown in FIG. 3 was provided in the clean room of 0.1 μm/class 10 where 10 or more fine grains having a size of 0.1 μm or less were contained in a volume of 1 $ft^3$. In this device, the air in the clean room was introduced into a body of pure water 72 having an electrical resistance of 18.3 MΩ. cm at 25° C. in gas washing containers 71 and washed in a two-stage manner by bubbling. Thereafter, the washed air was dehumidified by silica gel 73 and again discharged into the clean room by air pump 75 through flowmeter 74 which adjusted the discharged quantity of air.

In order to measure the effect of the air washing, the air in the clean room was bubbled continuously for 70 hours in pure water 72 at an air flow of 1.5 lit./min. This processed quantity of air was 6,300 lit. The concentration of $SiO_2$ contained in pure water 72 in washing container 71 was analyzed by induction coupling plasma (ICP) light emitting spectral analysis. As a result, the $SiO_2$ concentrations were as follows:

The pure water before the air washing 3–10 ppb

First stage washing container 407 ppb

Second stage washing container 71 ppb

It is presumed from those results that the $SiO_2$ concentration of the pure water in the first washing container was high compared to that before the air washing and that the $SiO_2$ grains contained in the air introduced into the washing container were obviously captured. As a result of calculation, it was understood that 83% of the $SiO_2$ contained in the air was removed at the first washing and 96% at the second washing.

It was confirmed by this experiment that the $SiO_2$ fine grains present in the air were captured by the pure water by washing the air in the clean room with the pure water.

What is claimed is:

1. A method for removing electric charges in a clean room comprising the steps of:

removing fine grains from air supplied to the clean room by using a first filter;

feeding the air from the first filter, which includes superfine grains, to a purifying discharge electrode, and thereby depositing superfine grains on the purifying discharge electrode to effect larger superfine grains;

feeding the air from the purifying discharge electrode to a second filter to capture with the second filter the larger superfine grains splashed from the purifying discharge electrode;

feeding the air from the second filter to a means partially enclosing an ion generating electrode which is provided in the clean room; and applying high voltage to the ion generating electrode to generate ions and feeding the ions into the clean room.

2. An apparatus for removing electric charges in a clean room comprising:

a first filter means provided in the clean room for eliminating fine grains;

ion generating electrode means provided in the clean room;

ion generating means for applying a voltage to said ion generating electrode means to feed ions from said ion generating electrode means into the clean room;

air discharge port for ventilating the air throughout of the clean room;

air feed port for feeding the air to the vicinity of the ion generating electrode means;

draft pipe means extending between said air discharge port and air feed port;

purifying discharge electrode means provided in said draft pipe means; and second filter means provided between said discharge electrode means and said air feed port.

3. An apparatus for removing electric charges in a clean room comprising:

a first filter means provided on the clean room for eliminating fine grains;

ion generating electrode means provided in the clean room;

ion generating means for applying a voltage to said ion generating electrode means to feed ions from said ion generating electrode means into the clean room;

air discharge port for ventilating the air throughout of the clean room;

air feed port for feeding air to the vicinity of the ion generating electrode means;

draft pipe means extending between the air discharge port and air feed port;

reservoir tank means for pure water provided in said draft pipe means; and means for causing purified air to bubble into said tank means.

* * * * *